United States Patent [19]

Caranicas

[11] 4,343,321

[45] Aug. 10, 1982

[54] HAIR CLIP

[75] Inventor: John C. Caranicas, Brookfield, Mass.

[73] Assignee: Braun Aktiengesellschaft, Kronberg, Fed. Rep. of Germany

[21] Appl. No.: 228,901

[22] Filed: Jan. 30, 1981

[51] Int. Cl.[3] ..... A45D 8/24

[52] U.S. Cl. ..... 132/48 A; 132/46 A

[58] Field of Search ..... 132/46, 48, 33 R

[56] References Cited

U.S. PATENT DOCUMENTS

| | | | |
|---|---|---|---|
| 2,498,066 | 2/1950 | Challinor | 132/48 R |
| 2,559,417 | 7/1951 | Florio | 132/48 R |
| 2,809,642 | 10/1957 | King . | |
| 2,905,186 | 9/1959 | Pfalzgraf . | |
| 3,376,875 | 4/1968 | Rosan . | |
| 3,587,595 | 7/1969 | Popeil | 132/46 A |

FOREIGN PATENT DOCUMENTS

| | | | |
|---|---|---|---|
| 1557294 | 7/1972 | Fed. Rep. of Germany . | |
| 2223276 | 11/1972 | Fed. Rep. of Germany . | |
| 2305040 | 8/1973 | Fed. Rep. of Germany . | |
| AD3823 | of 1906 | United Kingdom | 132/46 R |

*Primary Examiner*—G. E. McNeill

*Attorney, Agent, or Firm*—Raymond J. De Vellis

[57] ABSTRACT

A hair clip having a general "U" shape is provided with an arc segment on each of its two arms. The concave portions of the arc segments face one another. The arms are connected by a hinge portion. One of the arms is reinforced to control in which arm flexing occurs. The hair clip holds a generally cylindrical roller with its wound tress of hair in a direction generally perpendicular to the longitudinal axis of the cylindrical roller. The hair clip is adaptable to positively locate generally cylindrical rollers having a range of outside diameters.

7 Claims, 4 Drawing Figures

HAIR CLIP

BACKGROUND OF THE INVENTION

This invention relates to hair clips for securing a generally cylindrical roller with its wound tress of hair on the head of a user.

More particularly, this invention relates to a hair clip which may be utilized with cylindrical rollers having a range of outside diameters. The hair clip secures the generally cylindrical roller with its wound tress of hair in a direction generally perpendicular to the longitudinal axis of the cylindrical roller.

There are two general types of hair clips used to secure a generally cylindrical roller with its wound tress of hair on the head of a user. These types may be referred to as a longitudinal clip and a perpendicular clip. The longitudinal hair clip is meant to secure a roller with its wound tress in a direction generally parallel to the longitudinal axis of the roller. Typically, when a longitudinal clip, such as a bobbie pin, is used, the roller with its wound tress is secured by having one arm of the bobbie pin placed inside the hollow roller and the other arm placed over the wound tress. Accordingly, the tress tends to unwind to the pin. That is, a portion of the wound tress is lost in that the longitudinal clip defines a bending point for hanging the tress. It is therefore critical where a longitudinal clip is positioned.

The second type of hair clip, the perpendicular clip, secures the roller with its wound tress on the head of the user in a direction generally perpendicular to the longitudinal axis of the generally cylindrical roller. In general, the perpendicular clips are sized to match the outside diameter of a specific roller size. The necessity for perpendicular clips to be matched to the size of the roller makes it more likely that the wrong size clip will be used on the roller. This could lead to an improperly secured roller. Further, when the hair clip is made of a material such as metal, the improper use of prior art perpendicular hair clips could lead to permanent deforming of the hair clip after several uses.

The prior art problems and disadvantages mentioned above have been substantially overcome by the practice of this invention in which in a preferred embodiment a generally "U" shape hair clip, which secures the wound tress and roller on the head in a direction perpendicular to the longitudinal axis of the cylindrical roller, is provided. Each of the two arms of the hair clip, which are joined by a hinge portion, include an arc segment. The concave portion of the first arc segment faces the concave portion of the second arc segment. The arc segments are not concentric. That is, the first arc segment has a centerpoint different than the centerpoint of the second arc segment. Further, one of the arms of the hair clip is reinforced in order to get better confirmation of the hair clip to the head of the user.

SUMMARY OF THE INVENTION

It is an object of this invention to provide an improved hair clip for securing a generally cylindrical roller with a wound tress on the head of a user.

It is another object of this invention to provide a perpendicular hair clip which is adapted to releasably retain cylindrical rollers which have a range of outside diameters.

It is still another object of this invention to provide an improved hair clip which, when in use, conforms to the head of the user and does not unnecessarily interfere with adjacent clips and rollers on the head of the user.

It is still a further object of this invention to provide an improved hair clip which is easy to orient on the roller with its wound tress, and which is capable of holding a plurality of different types and sizes of rollers.

Briefly stated and accordingly to an aspect of this invention, the foregoing objects of this invention are achieved by providing in a preferred embodiment a generally "U" shaped hair clip which secures a generally cylindrical roller with a wound tress of hair on the head of the user in a direction generally perpendicular to the longitudinal axis of the hair roller. The hair clip has two arms, each of which contain an arc segment. The concave portions of the arc segments face one another. The first arc segment has a centerpoint which is different than the centerpoint of the second arc segment. The arms are connected by a hinged portion and one of the arms contains a reinforcement in order to control bending or flexing so that the hair clip better conforms to the head of the user.

BRIEF DESCRIPTION OF THE DRAWING

The invention both as to its organization and principles of operation together with further objects and advantages thereof may better be understood by referring to the following detailed description of an embodiment of the invention taken in conjunction with the accompanying drawing, in which.

DESCRIPTION OF THE PREFERRED EMBODIMENT

Figure 4:
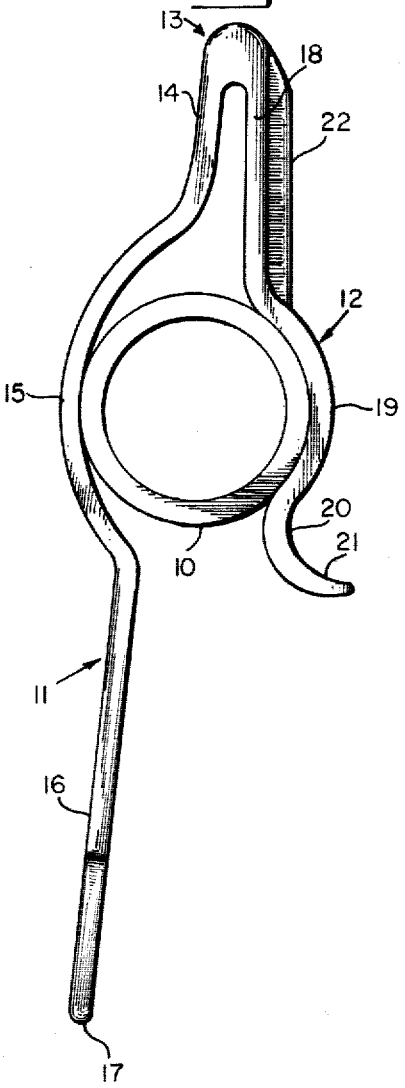
FIG. 4 is a side view of the hair clip securing a roller, in accordance with this invention.

Referring generally to the figures, in which reference numerals will be the same for like parts, a hair clip is shown for attaching a wound tress wrapped around a roller on the head of the user. As shown in FIG. 4, the hair clip is attached in a direction generally perpendicular to the longitudinal axis of a generally cylindrical roller 10. The associated roller 10 may be formed, in any well known fashion, from any suitable material such as a metal or plastic. The roller 10 may include protrusions, spacial gripping surfaces, or flanges. The hair clip of this invention is adapted to fit the type of generally cylindrical hair roller typically used as a component of a hair setter. The rollers may be brought to proper temperature by any technique well known in the art.

The air clip of this invention has a generally "U" shaped configuration and, in a preferred embodiment, is integrally formed by a technique such as injection molding, from a material such as a plastic. Nylon 6/6 is a suitable plastic in that it provide sufficient elasticity to releasably grip the associated hair roller and its wound tress. Preferably, the hair clip is of a one-piece integral construction, but it is considered to be within the scope of this invention to form the hair clip with a plurality of components.

The hair clip is formed of a first prong or longer arm 11 and a second prong or shorter arm 12 joined at a hinge portion 13. The hinge portion 13, which may be formed as a separate member and include a spring, provides the proper tension or biasing force for the arms 11 and 12 of the hair clip.

The longer arm 11 is made up of a top section 14, which is proximate the hinge portion 13. The top section 14 is followed by a first arc segment section 15, which is followed by a bottom section 16. The free end of the bottom section 16 includes a generally tapered tip portion 17.

The longer arm 11 acts as a guide to orient the hair clip on the associated roller after the roller has received its wound tress of hair.

In operation, the hair clip is positioned over or under the generally cylindrical roller, with its wound tress of hair, in a manner in which the longer arm 11 is positioned next to the scalp of the user in a direction generally perpendicular to the longitudinal axis of the associated cylindrical roller. The hair clip is positioned with its longer arm 11 next to the scalp of the user, to secure the associated roller and its wound tress, by positioning the hair clip with its longer arm 11 oriented in either a downward or upward position with respect to the roller.

The shorter arm 12 is made up of a top section 18, which is proximate to the hinge portion 13. The top section 18 is followed by a second arc segment section 19, which is followed by a bottom section 20. The free end of the bottom section 20 includes a leader portion 21.

The leader portion 21 is bent outward with respect to the longer arm 11. The shape of the leader portion 21 is designed to act as a lead for different diameter rollers and to allow the wound tress of hair to fall off, when unwound, without the hair catching or hanging on the hair clip.

Figure 1:
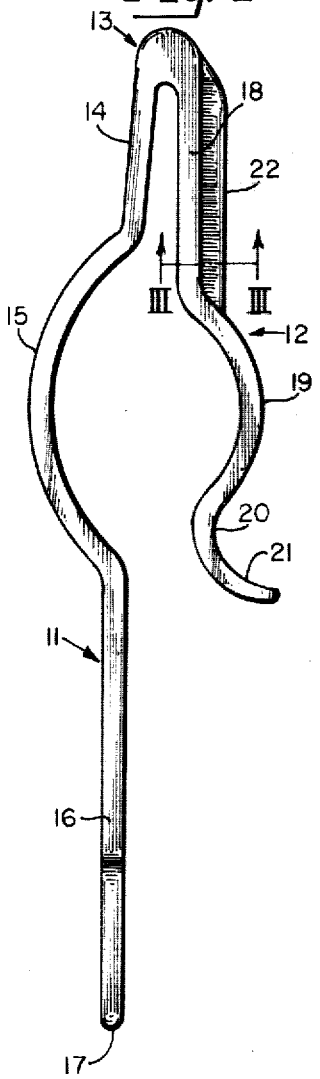
FIG. 1 is a side view of the hair clip, in accordance with this invention.
Figure 2:
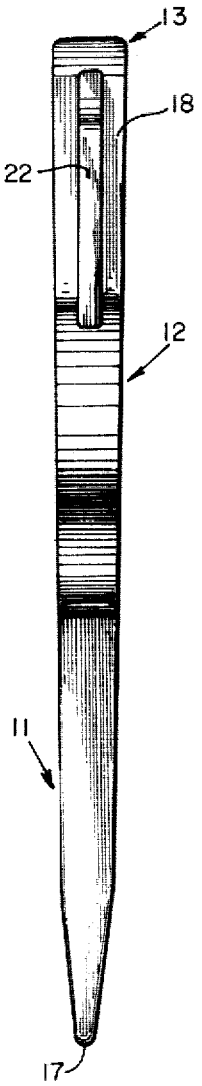
FIG. 2 is a front view of the hair clip, in accordance with this invention.
Figure 3:
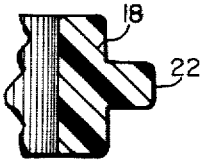
FIG. 3 is a cross-sectional view taken at line III—III of FIG. 1, in accordance with this invention.

A reinforcement rib 22 shown in cross-section in FIG. 3 at line III—III of FIG. 1 is preferably integrally molded with the top section 18 of the shorter arm 12. The rib reinforcement 22 is provided on the shorter arm 12 so that flexing of the hair clip occurs on the longer arm 11, when the hair clip is forced over the associated roller. When the hair clip is forced over a roller to retain the roller with its wound tress on the head of the user, the shorter arm 12 moves, but does not substantially bend. The longer arm 11 bends toward the head when the hair clip is forced over the roller. This provides that the hair clip better conforms to the head shape without interfering with the placement of other rollers and hair clips at proximate positions. That is, additional rollers may be secured with additional hair clips above or adjacent one another in a convenient manner.

In addition, the use of the hair clip of this invention prevents the associated hair roller from unnecessarily unwinding. This prevents sagging or drooping tresses which may result if a single hair roller is secured on the head of the user or if adjacent rollers are not positioned in the most desired location. That is, it is desirable to have the arm closest to the head of the user to flex so that there is not only better confirmation to the shape of the head to allow the use of multiple rollers, but also to provide that the rollers do not tend to unwind.

The concave portion of the first arc segment 15 faces the concave portion of the second arc segment 19. The first arc segment 15 has a centerpoint different than the centerpoint of the second arc segment 19. Thus, the first arc segment 15 and the second arc segment 19 are nonconcentric. In a preferred embodiment, the arc segment 15 on the longer arm 11 is larger than the arc segment 19 located on the shorter arm 12.

The specific dimensions of the hair clip are not critical, but in a preferred embodiment, the length from the top of the hinge portion 13 to the bottom of the tip portion 17 of the longer leg 11 is approximately three and one-half inches. The length of the shorter leg 12 from the top of the hinge portion 13 to the bottom of the leader portion 21 is approximately one and one-half to two inches. The thickness of the hair clip is approximately one-quarter inch at its thickest point.

It has been discovered that a hair clip having nonconcentric arc segments reliably secures generally cylindrical rollers having a range of outside diameters. The outside diameter of the associated rollers must be at least equal to the distance between the respective centers of the arc segments 15 and 19 when the hair clip is in the relaxed position, such as shown in FIG. 1 of the drawings. The maximum outside diameter of the rollers is limited by the maximum opened position, or maximum flexed position of the hair clip, as dictated by the material choice and type of hinge portion 13. In the maximum open position, the controlling dimension is again the straightline distance between the respective centers (bisected arc segments) of first arc segment 15 and second arc segment 19.

In a preferred embodiment, a single arc segment is formed on each arm of the hair clip for the purpose of gripping or holding the associated roller. Further, it is considered within the scope of this invention to have the arm 11 be of equal length to the arm 12, although the previously described configuration is preferable. It is also considered within the scope of this invention to have the arc segment on the shorter arm 12 greater than the arc segment on the longer arm 11.

While an embodiment and application of this invention has been shown and described, it will be apparent to those skilled in the art that many more modifications are possible without departing from the inventive concepts herein described. The invention, therefore, is not to be restricted except as necessary by the prior art and by the spirit of the appended claims.

What is claimed as new and desired to be secured by Letter Patent of the United States is:

1. A clip for securing a generally cylindrical hair roller with a wound tress of hair in a direction generally perpendicular to the longitudinal axis of the roller comprising:

a resilient member having a hinge portion, a first arm portion, and a second arm portion, said first arm portion and said second arm portion each having a first end and a second end, said first end of said first arm portion and said first end of said second arm portion being connected to said hinge portion thereby forming a general U shape, said first arm portion including a curved portion defining a first arc segment, said second arm portion including a curved portion defining a second arc segment, the concave sides of said first and second arc segments facing one another, said first arc segment having a different centerpoint than said second arc segment, said second arm portion including a reinforced area between said hinge portion and said second arc segment for providing that said first arm portion flexes more than said second arm portion when the clip is being positioned over the generally cylindrical roller, wherein said hinge portion provides sufficient tension to said first arm portion and said second arm portion to releasably retain between said first and second arc segments a generally cylindrical hair roller having a range of outside diameters.

2. The clip as in claim 1 wherein said reinforced area includes a rib portion integrally molded with said second arm.

3. The clip as in claim 2 wherein said first arm portion is longer than said second arm portion.

4. The clip as in claim 3 wherein said first arm portion, said second arm portion, and said hinge portion are all integrally molded.

5. The clip of claim 4 wherein said first arc segment is greater than said second arc segment.

6. The clip as in claim 5 wherein said second end of said first arm portion includes a generally tapered tip.

7. The clip as in claim 6 wherein said second end of said second arm portion includes a curved leader portion for guiding the associated roller.

* * * * *